United States Patent [19]

Gilliland et al.

[11] 4,418,508

[45] Dec. 6, 1983

[54] RUB STRIP ASSEMBLY HAVING LENGTHWISE GROOVE FOR RECEIVING SNAP-IN MEMBER

[75] Inventors: Keith E. Gilliland, Everett; Richard W. Morris, Bellevue, both of Wash.

[73] Assignee: The Boeing Company, Seattle, Wash.

[21] Appl. No.: 255,911

[22] Filed: Apr. 20, 1981

[51] Int. Cl.[3] ..... E04F 19/02

[52] U.S. Cl. ..... 52/282; 52/717

[58] Field of Search ..... 52/282, 463, 467, 717, 52/71, 718; 160/229 R, 210, 213

[56] References Cited

U.S. PATENT DOCUMENTS

| | | | |
|---|---|---|---|
| 987,143 | 3/1911 | Kritz | 52/282 |
| 1,307,973 | 6/1919 | Hester | 52/282 |
| 2,599,322 | 6/1952 | Drain | 52/467 |
| 2,882,564 | 4/1959 | Couse et al. | 52/282 |
| 3,388,523 | 6/1968 | Evans | 52/717 |
| 3,485,405 | 12/1969 | Dement | 52/282 |
| 3,517,473 | 6/1970 | Kistner et al. | 52/718 |
| 3,681,887 | 8/1972 | Loew | 52/718 |

FOREIGN PATENT DOCUMENTS

| | | | |
|---|---|---|---|
| 2230723 | 2/1973 | Fed. Rep. of Germany | 160/229 |
| 351369 | 6/1931 | United Kingdom | 52/717 |

*Primary Examiner*—John E. Murtagh
*Assistant Examiner*—Michael Safavi
*Attorney, Agent, or Firm*—Conrad O. Gardner; B. A. Donahue

[57] ABSTRACT

A universal rub strip of two-piece construction in which one member snap-fits into a lengthwise groove so that fasteners providing the support for the rub strip assembly are concealed. The universal rub strip assembly may be utilized in horizontal and vertical applications on doors, corners and, e.g., in a two pintle type hinge construction.

1 Claim, 8 Drawing Figures

RUB STRIP ASSEMBLY HAVING LENGTHWISE GROOVE FOR RECEIVING SNAP-IN MEMBER

The present invention relates to rub strips, bumper strips, and the like, which comprise two-piece assemblies, and more particularly to a rub strip assembly having a snap-in member.

Heretofore the prior art patent literature has included various types of rub strips, seals, bumper strips and the like which are of two-piece construction, e.g., U.S. Pat. No. 3,517,473. Heretofore, rub strips utilized in aircraft interiors to protect corners and surfaces from damage through gallery cart impact or passenger rubbing actions have failed to include fastener supports which remained concealed from a visual observation of the assembly. Full corner protection of interior aircraft panels including means for fastening the panel corners together while concealing the mounting fasteners have been unsatisfactory.

It is accordingly an object of the present invention to provide a rub strip assembly including installation fasteners which are concealed from view of the assembly.

It is another object of the present invention to provide means for protecting corners of assembled interior aircraft furniture units while further providing means for fastening the panel corners together.

It is yet another object of the present invention to provide horizontal and vertical rub strip assemblies for flat panel structure having concealed fastener mounting means.

It is yet a further object of the present invention to provide a rub strip assembly providing end panel protection without visible fastener mounting means.

It is still another object of the present invention to provide a corner rub strip assembly which includes a corner bumper bracket concealed behind the corner rub strip assembly from view in an aircraft interior installation.

It is still another object of the present invention to provide 270° hinge means for permitting a door to open 270° with associated vertical rub strip for providing corner protection.

In accordance with a preferred embodiment of the invention, a two-part rub strip assembly includes a first member of generally W-shaped cross section having a lengthwise groove included between the pair of base legs of the W for snap-fit insertion of a U-shaped channel member with ends abutting the bottom surface of the W section within the lengthwise groove thereby concealing mounting fasteners distributed along the lengthwise groove.

A full understanding of the present invention, and of its further objects and advantages and the several unique aspects thereof, will be had from the following description when taken in conjunction with the accompanying drawings in which.

Figure 6:
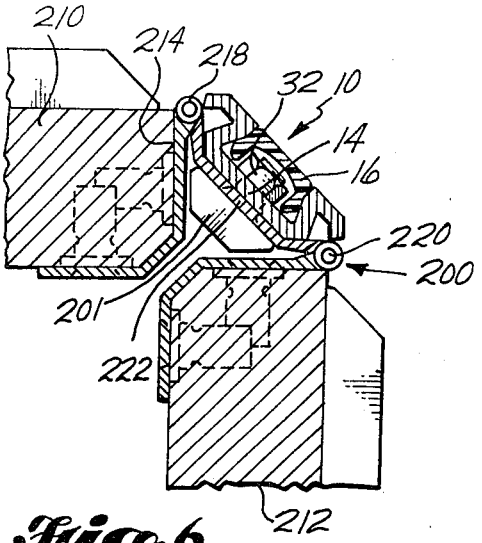
FIG. 6 shows in combination a 270° hinge assembly and rub strip assembly in accordance with the present invention which provides door opening to a full 270° open position, FIG. 6 showing the door in a fully closed position.
Figure 7:
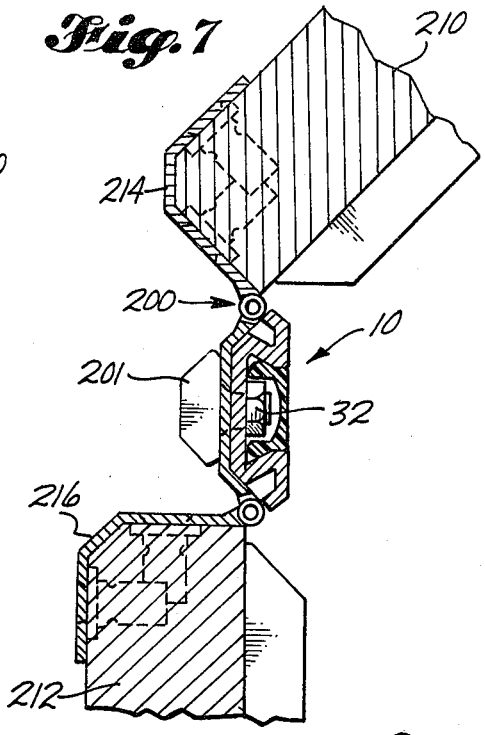
Figure 8:
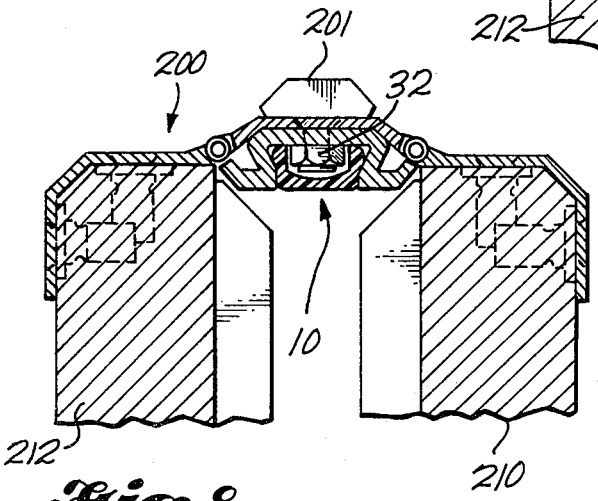

FIG. 7 is illustrative of the 270° hinge assembly and rub strip assembly of FIG. 6 showing the door in one-half open condition; and, FIG. 8 is illustrative of the hinge-rub strip assembly of FIGS. 6 and 7 wherein the door is shown in the full 270° open position.

Figure 1:
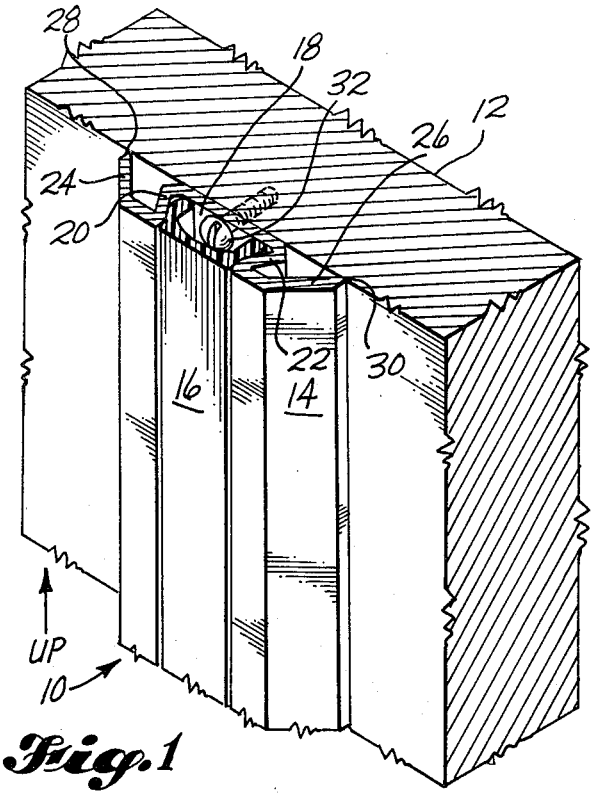
FIG. 1 is an isometrical view of the present rub strip assembly showing installation thereof in a vertical position on a flat panel member.

Turning now to FIG. 1, the present rub strip assembly 10 is shown in a vertical installation application on flat panel 12. Rub strip assembly 10 is seen to comprise a vertically extending elongated member 14 having a generally W-shaped cross section; and, a further U-shaped channel member 16 disposed in a snap-fit relationship within lengthwise groove 18 formed between inner short legs 20 and 22 of elongated W-shaped member 14. The ends 28 and 30 of outer leg members 24 and 26 of elongated member 14 having a W-shaped cross section are drawn flush and retained against the outer surface of panel 12 by a series of fasteners distributed along the center of the bottom of groove 18 (one of these fasteners is shown at 32).

Figure 2:
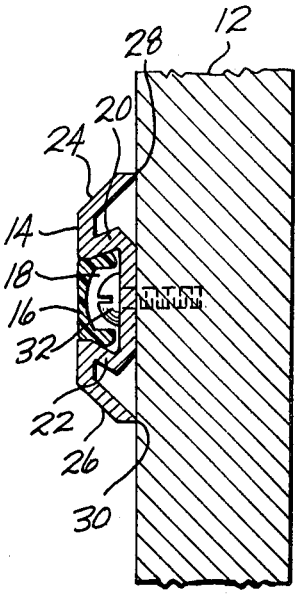
FIG. 2 is illustrative of a horizontal installation of the present rub strip assembly in cross section showing the manner of concealment from visual view of the supporting fasteners therefor.

Turning now to FIG. 2 showing a horizontal installation of rub strip assembly 10 on panel 12, this view of the installation in cross section further details a structure of the assembly 10. It can be readily seen how U-shaped channel member 16 which is snap-fit into member 14, viz., into lengthwise groove 18 formed between inner leg portions 20 and 22 thereof provides cover and concealment of underlying fastener 32 holding member 14 of W-shaped cross section against the outer surface of panel 12.

Figure 3:
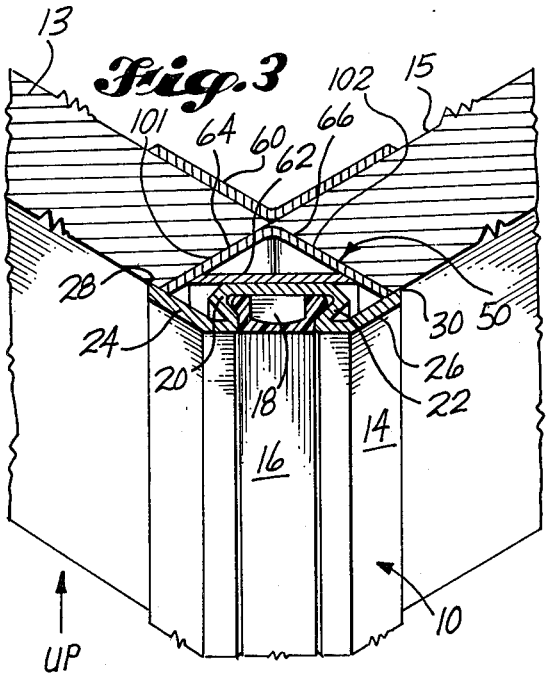
FIG. 3 is illustrative of a vertical isometric corner assembly utilizing the present rub strip for fastening panels of aircraft interiors together at the corners.
Figure 5:
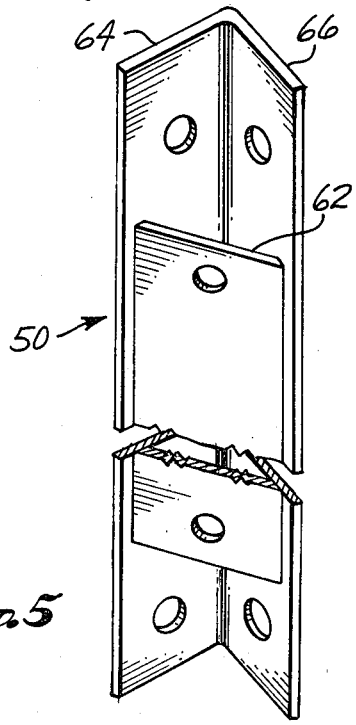
FIG. 5 is a perspective view of the corner bumper bracket utilized in the corner assembly of FIGS. 3 and 4.

FIG. 3 is illustrative of the utilization of the present vertical rub assembly 10 in a corner installation utilizing in combination therewith a corner bumper bracket member 50 shown in more detail in the perspective view taken thereof in FIG. 5. It can also be seen that in the corner assembly of FIG. 3 a right-angled corner bracket is utilized inside the corner assembly for added corner structure integrity.

Corner bumper bracket 50 differs from corner bracket 60 in that side leg members 64 and 66 extending at right angles have enclosed therebetween a longitudinally extending strip member 62 providing support through attachment of rub strip assembly 10.

Figure 4:
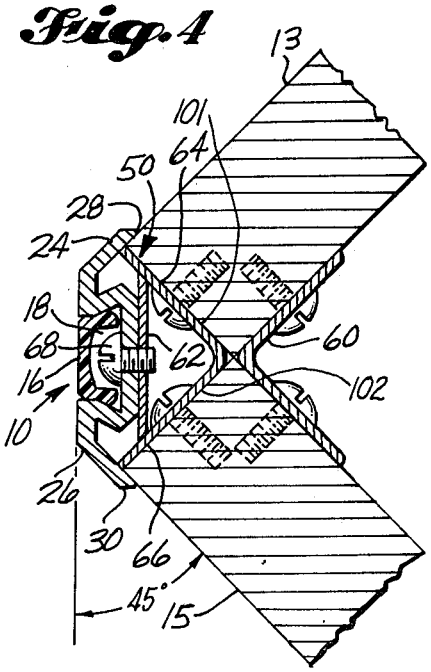
FIG. 4 is a sectional view-plan of the panel corner assembly of FIG. 3 showing intersection of the panels, corner bumper bracket, and fasteners utilized to secure the rub strip assembly to the corner bumper bracket for panel corner support.

The corner assembly of FIG. 3 is seen in the cross sectional view of FIG. 4 to comprise at the intersection of panel members 13 and 15 (with end surfaces 101 and 102) a corner bumper bracket 50 for securing panel member 13 and 15 together while also supporting from strip member 62 the hereinbefore described and shown rub strip assembly 10. As in the hereinbefore described embodiments of rub strip assembly 10, a fastening means one of which 68 is shown in the end cross sectional view here in FIG. 4 is adapted to be concealed in lengthwise groove 18 from exterior view by overlying U-shaped cross sectional channel member 16.

Elongated generally W-shaped member 14, and U-shaped cross section member 16 are made of ESTANE 58411, a polyurethane material which may be obtained from B. F. Goodrich Corporation. Right-angled corner bumper bracket member 50 having strip member 62 extending along the length of the right-angled slot formed between side-like portions 64 and 66 is made of aluminum sheet metal as is also right-angled corner member 60 utilized for reinforcement between panel members 13 and 15 and disposed on the inside corner between panel members 13 and 15. FIG. 5 has been included to show a perspective view of corner bumper bracket 50, already shown and described in FIG. 4. It can be readily seen that transverse member 62 comprises a strip extending along the region between the right-angled bend of legs 64 and 66, entire corner of bumper bracket member 50 being manufactured of aluminum sheet metal.

FIGS. 6, 7 and 8 show 270° hinge assembly 200 in combination with rub strip assembly 10 in various stages of translation of door member 210 to a full 270° open position as shown in FIG. 8.

Turning now to the 270° hinged door structure of FIG. 6 shown in the fully closed position, it can be seen that 270° hinge 200 comprises a first hinge half 214 and a second hinge half 216 coupled through hinge pins 218 and 220, respectively, to the sides of hinge center linkage bar 222. Hinge halves 214 and 216 comprise piano hinge structures well known per se in the art. Hinge center linkage bar 222 accepts rub strip assembly 10 when secured as shown by fastener means 32. Rub strip assembly 10 includes as hereinbefore discussed a first member 14 of W-shaped cross section having a lengthwise groove for receiving channel member 16 of U-shaped cross section thereby providing the resilient assembly 10. Resilient rub strip assembly 10 is thus seen mounted on the outer portion of hinge center linkage bar 222 while nylon bumper member 201 is seen mounted on the inside surface of hinge center linkage bar 222 for cushioning hinge member 200 when door 210 is in the fully closed position with respect to wall 212 of, for example, the closet structure of an aircraft. Proceeding now to FIGS. 7 and 8, the path of hinge structure 200 with associated rub strip assembly 10 can be observed as closet door 210 is rotated through the one-half open position in FIG. 7 to the fully open position of 270° as shown in FIG. 8.

We claim:

1. A corner assembly for fastening together the end surfaces (101 and 102) of first and second panel members in 90 degree relationship with respect to the major surface areas of said panel members comprising in combination:

a right angle corner bumper bracket disposed for fastening between said end surfaces (101 and 102) of said first and second panel members, said right angle corner bumper bracket including a transversely disposed strip extending along said bumper bracket in the region forming the right angle thereof;

an elongated member having first and second leg portions and a lengthwise groove extending along the length of said elongated member between said first and second outer leg portions, said lengthwise groove including a plurality of fasteners distributed along the length thereof for fastening said elongated member to said transversely disposed strip, said first and second outer leg portions abutting said major surface areas of said first and second panel members;

a channel member having sides, said sides having end portions, and said channel member having a generally U-shaped cross section disposed within said lengthwise groove with said end portions of the sides of said channel member abutting the bottom surface of said lengthwise groove.

* * * * *